US012369667B2

(12) United States Patent
Mazzarolo et al.

(10) Patent No.: US 12,369,667 B2
(45) Date of Patent: Jul. 29, 2025

(54) WEARABLE PROTECTION DEVICE

(71) Applicant: ALPINESTARS RESEARCH S.P.A., Maser (IT)

(72) Inventors: Giovanni Mazzarolo, Coste di Maser (IT); Lorenzo Nardo, Ponzano Veneto (IT); Filippo Galassini, Palazzolo dello Stella (IT)

(73) Assignee: ALPINESTARS RESEARCH S.P.A., Maser (IT)

( * ) Notice: Subject to any disclaimer, the term of this patent is extended or adjusted under 35 U.S.C. 154(b) by 94 days.

(21) Appl. No.: 18/004,733

(22) PCT Filed: Jul. 9, 2021

(86) PCT No.: PCT/EP2021/069178
§ 371 (c)(1),
(2) Date: Jan. 9, 2023

(87) PCT Pub. No.: WO2022/013103
PCT Pub. Date: Jan. 20, 2022

(65) Prior Publication Data

US 2023/0248101 A1 Aug. 10, 2023

(30) Foreign Application Priority Data

Jul. 13, 2020 (IT) ..... 102020000016930

(51) Int. Cl.
*A42B 3/04* (2006.01)

(52) U.S. Cl.
CPC ..... *A42B 3/0486* (2013.01); *A42B 3/0473* (2013.01)

(58) Field of Classification Search
CPC .... A63B 71/10; A41D 13/018; A42B 3/0486; A42B 3/0473
See application file for complete search history.

(56) References Cited

U.S. PATENT DOCUMENTS 5,133,084 A 7/1992 Martin
5,860,162 A 1/1999 Love
(Continued)

FOREIGN PATENT DOCUMENTS

DE 19631465 A1 2/1998
JP 3104644 U 10/2004
WO 2019022675 A1 1/2019

OTHER PUBLICATIONS

PCT International Search Report and Written Opinion dated Oct. 13, 2021 for Intl. App. No. PCT/EP2021/069178, from which the instant application is based, 9 pages.

*Primary Examiner* — Katherine M Moran
(74) *Attorney, Agent, or Firm* — Fredrikson & Byron, P.A.

(57) ABSTRACT

A wearable protection device, including a protective helmet with at least one first inflatable chamber for moving between a rest condition in a deflated status and an operating condition in an inflated status, and a wearable element including an inflator unit and an activation system to trigger the inflator unit if a danger situation for the user of the wearable protection device is identified. The wearable element includes at least one second inflatable chamber for moving between a rest condition when in deflated status and an operating condition when in inflated status. The inflator unit is connected to the first inflatable chamber and/or the second inflatable chamber. The inflator unit inflates the first inflatable chamber and/or the second inflatable chamber in the operating condition when a danger situation for the user of the wearable protection device is identified by the activation system.

18 Claims, 6 Drawing Sheets

(56) References Cited

U.S. PATENT DOCUMENTS

| | | | | |
|---|---|---|---|---|
| 7,841,344 | B2 * | 11/2010 | Schlosser | A63B 29/021 441/106 |
| 9,788,588 | B2 * | 10/2017 | Allen | A42B 3/12 |
| 10,165,806 | B2 * | 1/2019 | Duncan | A42B 3/0486 |
| 10,925,331 | B2 * | 2/2021 | Mazzarolo | A41D 1/002 |
| 11,975,677 | B2 * | 5/2024 | Yanagisawa | B60R 21/0132 |
| 2012/0073035 | A1 | 3/2012 | Mazzarolo et al. | |
| 2022/0053847 | A1 * | 2/2022 | van der Sleesen | A41D 13/0531 |
| 2022/0295918 | A1 * | 9/2022 | Yanagisawa | A41D 13/0525 |
| 2024/0032624 | A1 * | 2/2024 | Cavell | A41D 13/018 |

* cited by examiner

WEARABLE PROTECTION DEVICE

RELATED APPLICATIONS

This application is a 35 U.S.C. 371 national stage filing from International Application No. PCT/EP2021/069178, filed Jul. 9, 2021, which claims priority to Italian Application No. 102020000016930, filed Jul. 13, 2020, the teachings of which are incorporated herein by reference.

FIELD OF THE INVENTION

The present invention relates, in general, to the technical field of wearable protection devices. In particular, the present invention relates to a wearable protection device provided with an inflatable member suitable for being inflated in case of danger, so as to offer an additional protection to the user against impacts and/or falls. More in particular, the present invention relates to a wearable protection device provided with an inflatable member designed to protect specifically the neck, or the neck in combination with the torso, of the user from injuries in case of impacts and/or falls.

BACKGROUND

Wearable protection devices provided with an inflatable member are also called "wearable airbag devices" and are suitable for being worn during different types of activities, like riding motorcycle, cycling, skiing, walking or during industrial working activities and the like.

Typically, a wearable airbag device consists of a wearable item, like for example a helmet, a jacket, a suit, a vest, a belt, etc. The wearable item generally contains: an inflatable bag or chamber, inflation means of the bag and a system to activate the inflation means. The activation system can be electronic, for example on the basis of data detected by sensors applied on the wearable item and/or on a vehicle used in combination with the wearable airbag device, or mechanical, for example by means of a cable connecting the wearable item to the vehicle used in combination with the wearable airbag device.

In the motorcycle sector, the neck of the user is one the area most critical to protect, since this area, even if the motorcyclists wear a helmet, remains exposed and vulnerable.

Recently, airbag collars, airbag helmets or airbag vests, having a part of the inflatable bag designed to protect the neck, have been studied.

All these airbag devices are basically standalone devices, namely they are designed to be worn independently from any additional protective device.

Airbag collars usually comprise a housing, suitable for being applied around the neck portion of the user, inside which the inflatable bag, the gas cartridge and the activation system are provided.

Airbag helmets are airbag systems directly provided inside the helmet shell, in order to improve the protection offered by the helmet, in particular at the neck zone.

In the airbag helmets the inflatable bag is usually arranged inside the helmet and/or at the lower rim of the helmet. Activation system and inflatable means are provided inside the helmet.

Airbag vests can be provided with an inflatable bag having a portion designed to cover the user neck. In these devices the inflatable bag has generally a portion arranged over the shoulder area of the vest. Such a portion is designed to expand outwardly from the vest, so as to be able to cover at least partially the neck of the user in case of danger.

All these airbag devices, even if they are appreciated, have some drawbacks.

As a matter of fact, the airbag collars and the airbag helmets since they contain inside their structure all the devices needed for the activation, like for example the gas generators, sensors and control unit, are bulky and uncomfortable.

Moreover, the provision of all components of the activation system of the airbag inside the collar or the helmet makes the latter heavy.

Furthermore, in case of a huge impact, in the most extreme events, even if the gas generators, sensors and control unit are safely embedded inside the collar and the helmet, they can come into contact with the user's head, bruising or even injuring the user.

Finally, in case of the airbag helmets, shape and dimensions of the outer protective shell must be necessarily adjusted to allow the insertion inside the helmet of the devices needed for the activation of the airbag. As it is well known in the art, the oval shape of the shell is designed to offer both an adequate protection against impacts to the user's head and to permit, in case of an accident, the sliding of the helmet over the ground, since the blocking of the helmet might cause a dangerous rotational acceleration on the brain of the user.

Therefore, the needing to insert the various devices of the airbag system inside the helmet can force to move away from the ideal oval shape of the shell by inserting corners or protrusions which can affect the sliding of the helmet over the ground.

The vest provided with inflatable bag designed to protect the neck in turn necessarily needs to be worn on top of additional garment. Otherwise the expansion of the inflatable bag towards the neck will be hindered. At the same time, for allowing the expansion of the airbag, the vest should be provided with zones having a programmed yieldability in order to assure that the airbag can deploy outwardly. The manufacturing of the vest is thus costly. Moreover, the vest, once it is activated, necessarily needs to be changed with a new one.

Furthermore, it is evident that if the user wants to protect not only his neck but also his torso and other parts of his body by means of an airbag system, needs to use the airbag collars or the airbag helmets in combination with garments provided with their own inflatable bags. Consequently, the user is forced to wear two distinct wearable airbag devices, each having its own detection and deployment systems with the risk that such devices might interfere to each other.

BRIEF SUMMARIES OF OBJECTS OF THE INVENTION

The main object of the present invention is therefore to provide a wearable protection device comprising an inflatable chamber configured to overcome or at least reduce the drawbacks above mentioned with reference to the known wearable airbag devices designed to protect the neck of the user.

More specifically, the main object of the present invention is to provide a wearable protection device suitable for providing an improved protection to the neck of the user, without affecting the comfort and the wearability of the protection device. A further object of the present invention is to provide a wearable protection device which, in addition to offer an improved protection to the neck of the user, is easy to use and wear. Moreover, an object of the present invention is to provide a wearable protection device which, in addition to offer an improved protection to the neck of the user, has a simplified structure.

Furthermore, an object of the present invention is to provide a wearable protection device which, in addition to offer an improved protection to the neck of the user, also offers an enhanced protection to other parts of the user's body.

Another object of the present invention is to provide a wearable protection device which, in addition to offer an improved protection to the neck and the body of the user, is easy to maintain.

The above-mentioned objects, and other objects that will better appear in the following of the present description, are achieved by a wearable protection device according to claim 1.

BRIEF DESCRIPTIONS OF THE DRAWINGS

The advantages and the characteristic features of the invention will appear more clearly from the following description of preferred, but not exclusive, embodiments of the wearable protection device with reference to the accompanying figures in which.

DETAILED DESCRIPTION OF EMBODIMENTS OF THE INVENTION

With reference to the attached figures, a wearable protection device according to the present invention is indicated, in its whole, by the reference 10.

Figure 11:
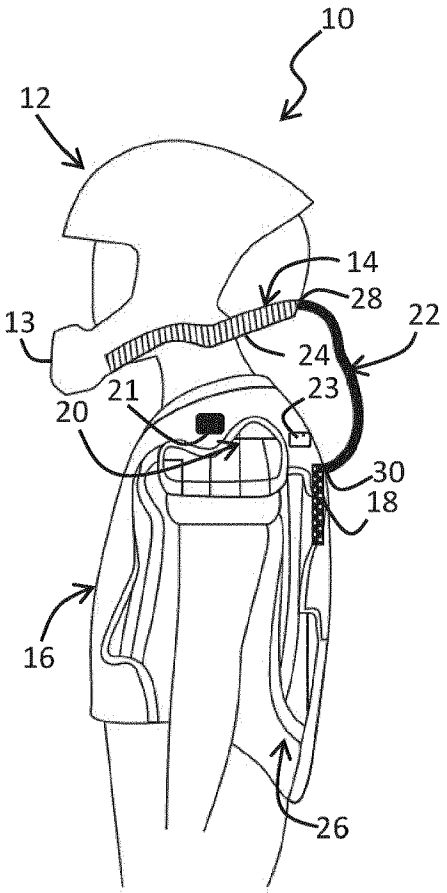
FIG. 11 shows, in schematic form, a partially sectioned side view of a wearable protection device, worn by a user, according to a second embodiment of the present invention.

The wearable protection device 10 comprises a protective helmet 12 which is provided with at least one first inflatable chamber 14. Said first inflatable chamber 14 is suitable for moving between a rest condition, wherein it is in a deflated status (see for example FIGS. 1 and 11), and an operating condition, wherein it is in an inflated status (see for example FIGS. 2 and 12).

The wearable protection device 10 further comprises a wearable element 16 which in turn comprises an inflator unit 18 and an activation system 20.

The activation system 20 is designed to trigger the inflator unit 18 if a danger situation for the user of the wearable protection device 10 is identified.

According to the invention, the inflator unit 18 can be connected to the first inflatable chamber 14. In detail, the inflator unit 18 can be designed to inflate the first inflatable chamber 14 so as to move the first inflatable chamber 14 in the operating condition when a danger situation for the user of the wearable protection device 10 is identified by the activation system 20.

As a danger situation should be intended a situation wherein the wearable element 16 undergoes a sudden acceleration/deceleration and/or a sudden variation in its orientation and/or in its angular velocity.

In particular, when the user of the wearable protection device is on a vehicle, like for example a motorcycle, a sudden acceleration or deceleration undergone by the wearable element identifies, for example, that the motorcycle has hit an obstacle or that the user has lost the control of the motorcycle being thrown from the saddle.

With reference to the enclosed figures, a protective helmet 12 suitable for being used by a motorcyclist is shown. Nevertheless, as it will appear more clearly from the following description, the wearable protection device 10 can comprise a protective helmet 12 of the type used by cyclists, skiers and hockey, football, polo or other sports players which need an effective protection of the head.

The protective helmet 12 can also be a hard hat suitable for being used in workplace environments.

In the enclosed figures a protective helmet 12 provided with a chin guard 13 is shown. However, the teachings of the present invention may also be advantageously applied to the so-called "jet helmets".

As above mentioned, the protective helmet 12 is provided with at least one first inflatable chamber 14 which is designed to protect the neck of the user once inflated.

Said first inflatable chamber or bag 14 can be manufactured by sewing together a lower panel and an upper panel along their perimetric portions, so as to obtain the so-called "sewed" airbag.

Alternatively, the first inflatable chamber 14 can be manufactured by means of a single weaving operation, using for example a Jacquard loom so as to obtain the so-called "one piece woven" (OPW) airbag, or by means of a knitting operation.

In a further embodiment the first inflatable chamber 14 can be made with an elastic material, preferably chosen in the group comprising natural rubbers or synthetic rubbers.

The first inflatable chamber 14 can be provided with internal tethers (not shown in the enclosed figures) suitable to control the expansion of the inflatable chamber 14 during the moving in the operating condition.

Preferably, as it is shown in the attached figures, the first inflatable chamber 14 is applied at a lower portion of the protective helmet 12 (see for example FIGS. 1, 3, 4, 11 and 14). In this way, the first inflatable chamber 14 faces the upper torso portion of the user of the wearable protection device 10 and, once inflated, it is able to expand from the lower rim of the protective helmet 12 towards the user's body so as to cover and protect the neck of the user. In particular, once inflated, the first inflatable chamber 14 is designed to fill the gap between the lower rim of the protective helmet 12 and the upper portion of the wearable element 16.

Advantageously, the first inflatable chamber 14 is partially or fully installed inside the lower portion of the protective helmet 12 (see for example FIGS. 4-7).

Preferably, the first inflatable chamber 14 is installed in a portion usually occupied by the "neck roll", namely the compressible foam which, in the form of a long cylindrical foam piece, extends around the lower portion of the protective helmet 12.

Consequently, when the protective helmet 12 is worn, the first inflatable chamber 14 is positioned around the neck of the user. In particular, the first inflatable chamber is interposed between the lower portion of the helmet and the shoulders, the top portion of the chest and/or the top portion of the back of the user (see for example FIGS. 3 and 14).

Figure 5:
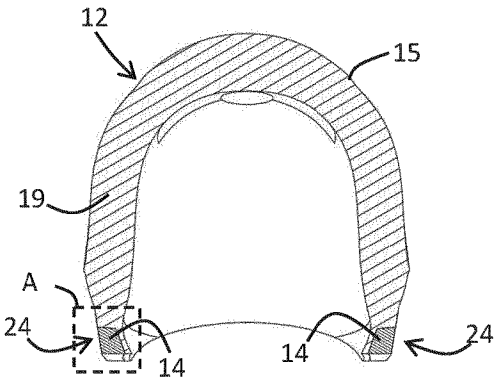
FIG. 5 is a cross-sectional view taken along the line V-V of FIG. 4.
Figure 6:
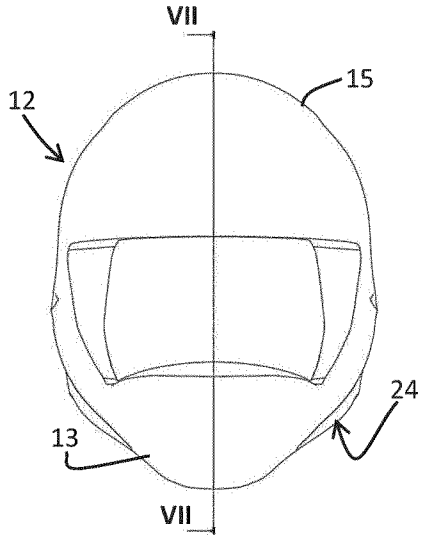
FIG. 6 shows a front view of the protective helmet of FIG. 4.
Figure 7:
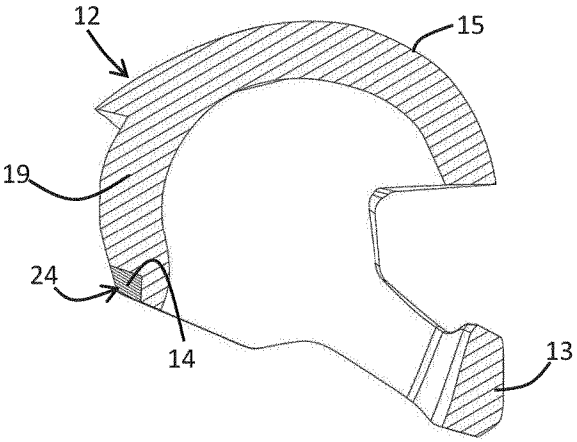
FIG. 7 is a cross-sectional view taken along the line VII-VII of FIG. 6.

Advantageously, such a positioning does not affect shape and dimensions of the outer shell 15 and impact absorbing liner 19 of the protective helmet 12 (see FIGS. 5 and 7). Moreover, being positioned at the lower portion of the protective helmet, the first inflatable chamber 14 can be easily replaced after the activation, without needing the replacement of the whole protective helmet if the latter has no undergone structural damages during the incident.

Preferably, the first inflatable chamber 14 is provided inside a housing 24 applied or arranged at the lower rim of the protective helmet 12.

Advantageously, the housing 24 can also be installed on the lower rim of already existing protective helmets without needing to modify their structure. In this case, it will only be necessary to provide corresponding fastening means between the existing protective helmet and the housing 24.

Figure 2:
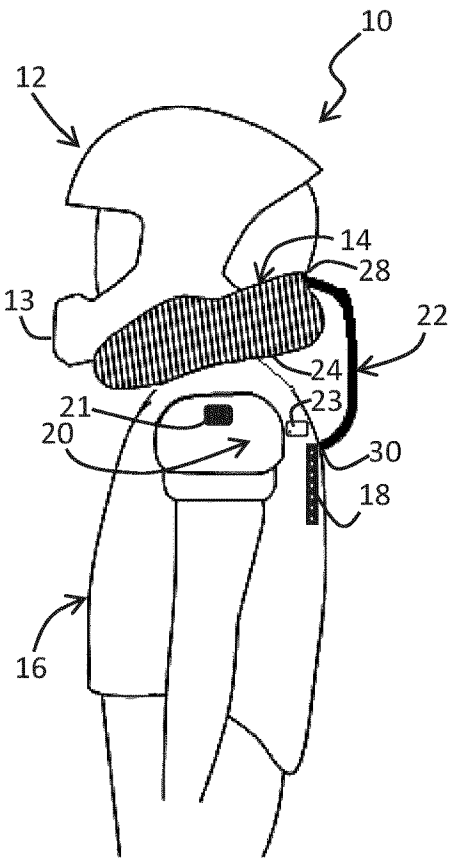
FIG. 2 is a figure similar to FIG. 1 wherein the inflatable chamber of the wearable protection device is in the inflated status.
Figure 1:
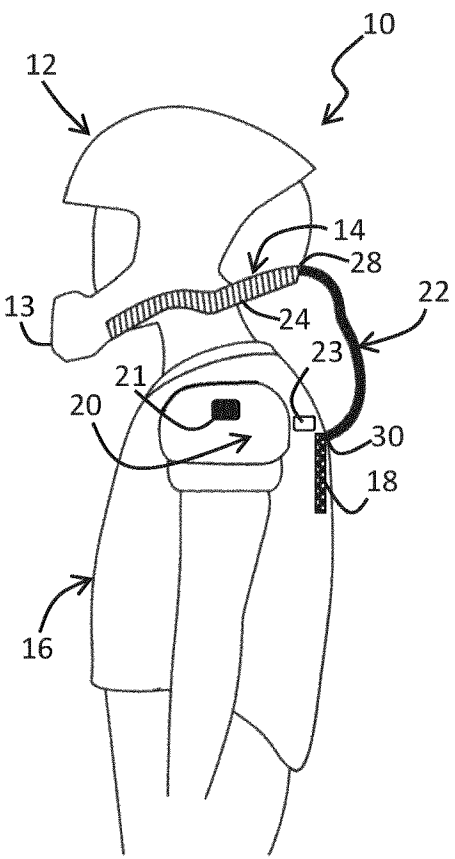
FIG. 1 shows, in schematic form, a side view of a wearable protection device, worn by a user, according to a first embodiment of the present invention.
Figure 4:
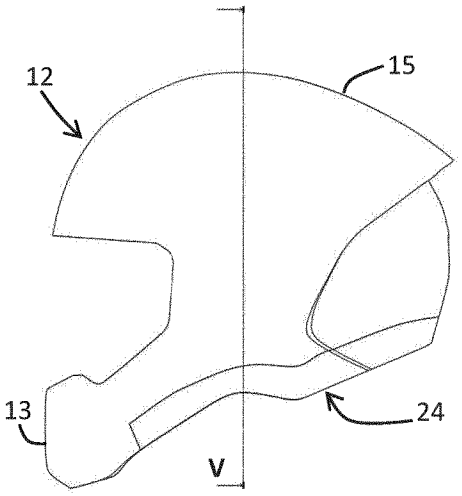
FIG. 4 shows a side view of a further embodiment of the protective helmet of the wearable protection device of the present invention.

The housing 24 can be made of flexible and elastic material so as not to hinder the expansion of the first inflatable chamber 14 once it is inflated (see for example FIGS. 1-2).

Figure 5B:
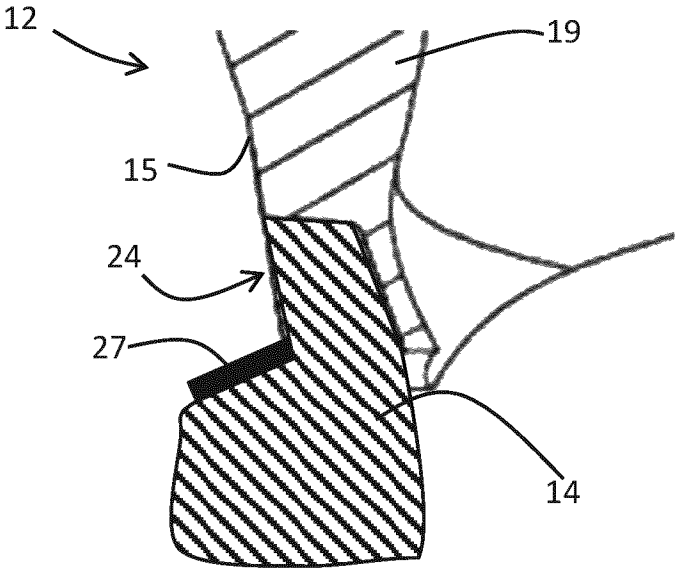
FIG. 5B is a view similar to FIG. 5A but showing the protective helmet in a different operating condition.

Alternatively, the housing 24 can be made with a semi-rigid or rigid material having formed therein an opening which extends through the bottom edge of the housing (see for example FIGS. 4-7). Such an opening is closed by a movable lid 27 pivotally mounted at the housing (see FIGS. 5*a* and 5*b*).

Figure 5A:
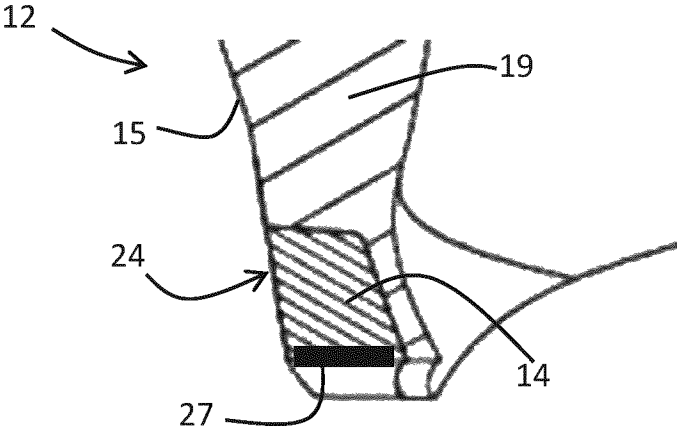
FIG. 5A is an enlarged view of the detail A of the protective helmet of FIG. 5.

During the normal use of the wearable protection device 10 the lid 27 is designed to remain in a closed configuration, so as to assure that the first inflatable chamber 14 is safely housed inside the housing 24 (see FIG. 5A). At the same time, the lid 27 is designed to move in an open configuration when the inflatable chamber 14 moves in its active configuration, so as to permit the expansion of the first inflatable chamber 14 (see FIG. 5B).

The lid 27 can also be opened if an inspection or a removal of the first inflatable chamber 14 from the housing 24 is needed.

In a further embodiment, the first inflatable chamber 14 or the housing 24 inside which the first inflatable chamber 14 is housed can be fixed to the lower rim of the protective helmet 12 by means of releasable fixing means 36. In this way, the first inflatable chamber 14 can be replaced, by simply releasing the fixing means 36.

Figure 9:
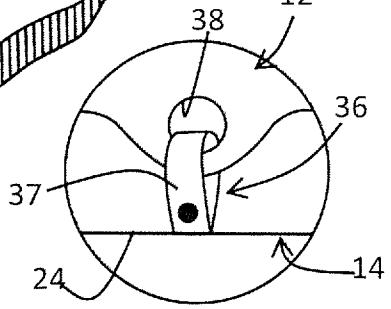
FIG. 9 shows an enlarged view of a detail of FIG. 8.

The releasable fixing means 36 can comprise hooks with buttons, hook-and-loop fasteners or similar. In FIG. 9, it is shown an embodiment wherein the releasable fixing means 36 consist in a releasable strap 37 applied at a perimetral portion of the first inflatable chamber 14 or the housing 24 and designed to engage a corresponding slot 38 provided at lower rim of the protective helmet 12.

Advantageously, the first inflatable chamber 14 can be applied at the lower portion of the protective helmet 12 or can be positioned inside the housing 24 in a folded configuration so as to occupy a limited volume of the helmet. In this way, the first inflatable chamber 14 does not hinder the freedom of movement of the user's head.

Figure 10:
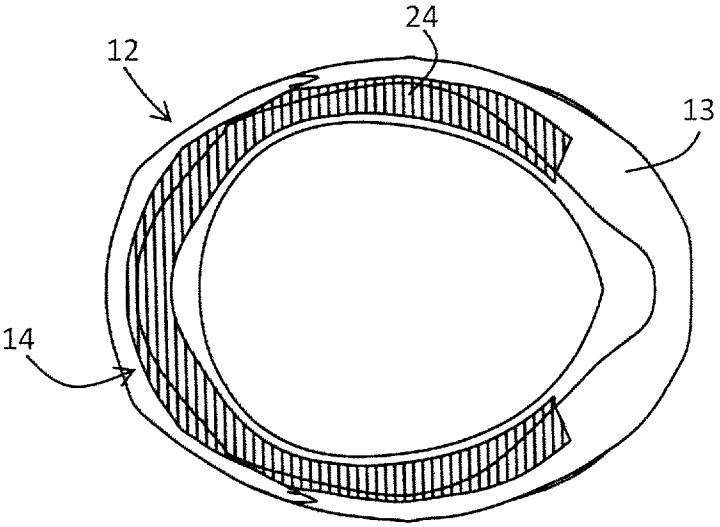
FIG. 10 is a bottom view of the protective helmet of FIG. 8.
Figure 8:
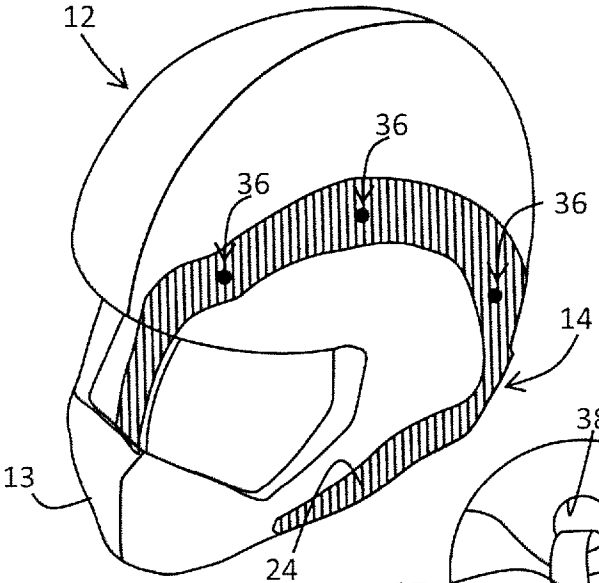
FIG. 8 shows a perspective front view of the protective helmet of FIG. 1.

In the attached figures, the protective helmet 12 comprises a single first inflatable chamber 14 extending along the entire lower rim of the protective helmet 12, with the exception of the chin guard 13 (see FIG. 10).

However different arrangements are possible. For example, the protective helmet 12 can comprise two or more first inflatable chambers 14 provided along different portions of the lower rim of the protective helmet.

The wearable protection device 10 also comprises a wearable element 16.

Preferably, the wearable element 16 is designed to cover at least a trunk portion of the user's body.

Figure 3:
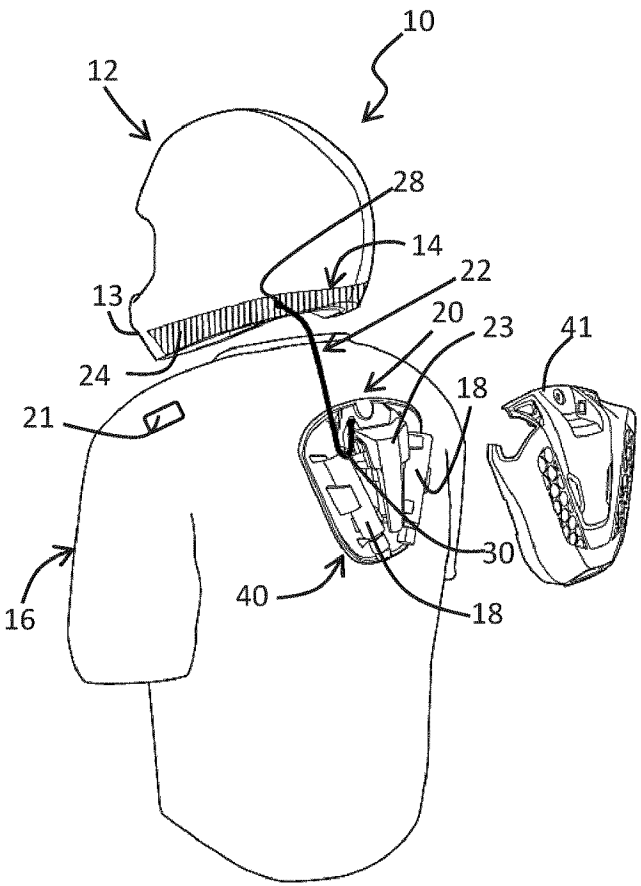
FIG. 3 shows a perspective rear view, partially exploded, of a further embodiment of the wearable protection device according to the invention.

The wearable element 16 can be a protective garment, like for example a jacket, a suit or a vest (see for example FIGS. 1-3). Alternatively, the wearable element can be an undergarment 16 suitable for being worn under an outer protective garment 17 (see for example FIGS. 11-13). In a further embodiment, not shown in the attached figures, the wearable element 16 can be a harness or a belt designed to be worn on top or under a further garment.

Advantageously, the wearable element can also be a garment for an elderly person, like a pair of shorts, or briefs, suitable to cover and to protect the hips of the user.

The wearable element 16 comprises the inflator unit 18 designed to inflate the first inflatable chamber 14 applied at the protective helmet 12.

Preferably the inflator unit 18 is chosen from the group comprising pyrotechnic inflators, compressed gas inflators and hybrid inflators.

The inflator unit 18 can comprise a plurality of inflation charges so as to be able to inflate the first inflatable chamber 14 more than once in a chronological order.

As it is shown in FIGS. 1-2 and 11-12, the inflator unit 18 is applied at the portion of the wearable element 16 covering the back of the user. Preferably, the inflator unit 18 is provided inside a rigid or semi-rigid casing 40 applied at the back portion of the wearable element 16 (see FIGS. 3 and 14). The casing 40 can be closed by a removable cover 41 so as to permit the user to easily access to the inflator unit if needed.

Figure 13:
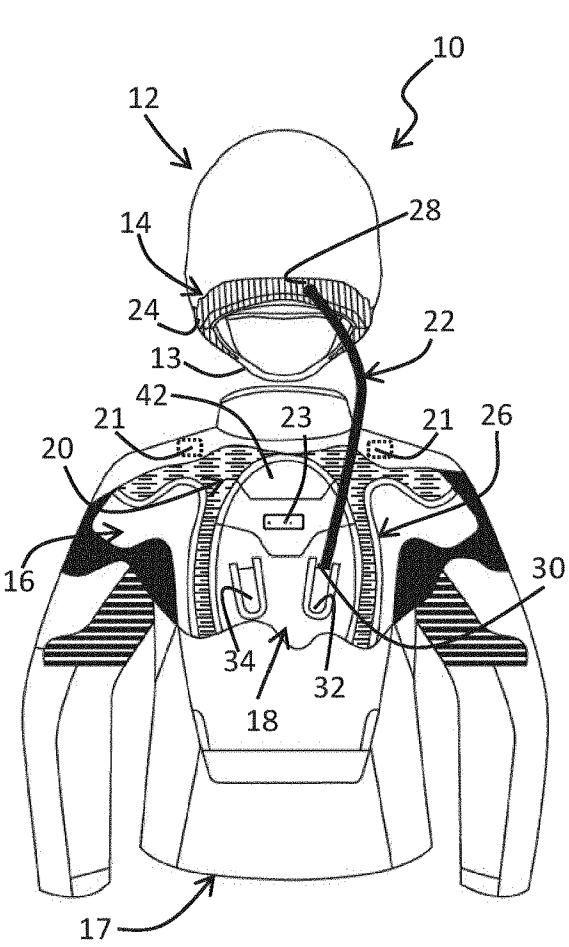
FIG. 13 shows a partially sectioned rear view of a further embodiment of the wearable protection device according to the invention.

Alternatively, the inflator unit 18 can be provided inside a back protector 42 applied at the back portion of the wearable element 16 (see for example FIG. 13).

Figure 14:
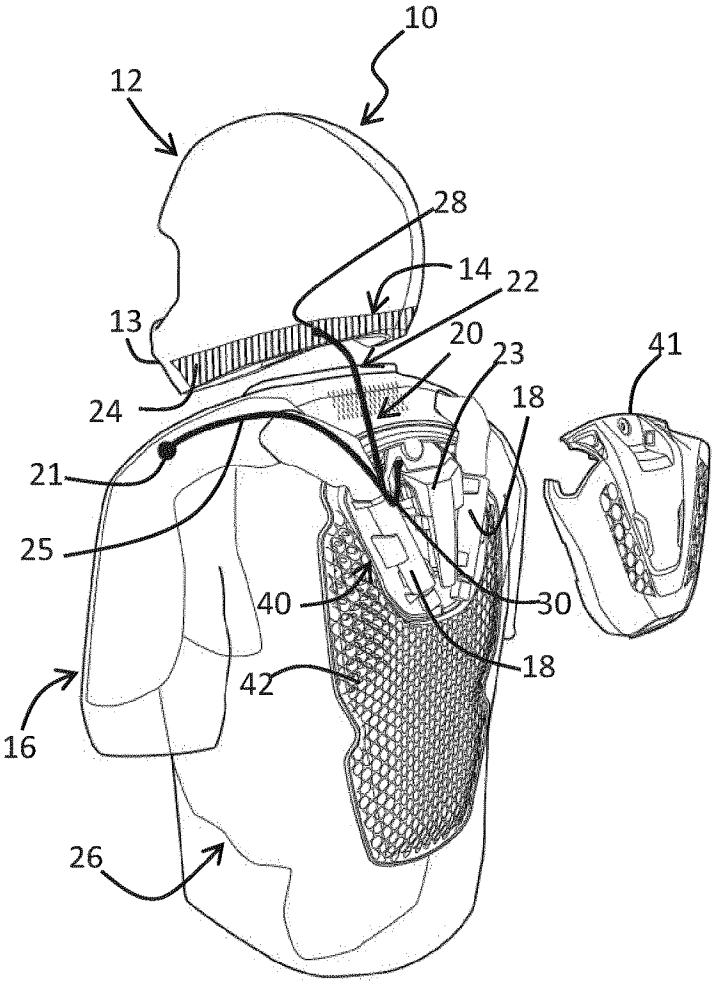
FIG. 14 shows a perspective rear view, partially exploded, of a different embodiment of the wearable protection device according to the invention.

Advantageously, the casing 40 containing the inflator unit 18 can be integrated in the upper portion of the back protector 42 (see for example FIG. 14).

The inflator unit 18 can comprise a single gas cartridge (see for example FIGS. 1-2) or a plurality of gas cartridges (see FIGS. 3 and 13).

The inflator unit 18 is directly or indirectly connected to the first inflatable chamber 14 by means of a connecting hose 22.

Advantageously the connecting hose 22 is made with a flexible material. Preferably the connecting hose 22 is made with a reinforced flexible material, for example reinforced rubber.

The connecting hose 22 is designed to be positioned at least partially inside the wearable element 16 so as to be exposed only for a limited extension. In this way the risk that the connecting hose 22 in case of accident might be caught in external objects is reduced.

In case of a direct connection between the inflator unit 18 and the first inflatable chamber 14, the connecting hose 22 has a first end 28 designed to be connected to the first inflatable chamber 14 and a second end 30 designed to be connected to the inflator unit 18. First end 28 and second end 30 are respectively connected to the first inflatable chamber 14 and to the inflator unit 18 in a gas-tight manner.

In case of an indirect connection between the inflator unit 18 and the first inflatable chamber 14, the connecting hose 22 has a first end 28 designed to be connected to the first inflatable chamber 14 and a second end 30 designed to be connected to an intermediate element in turn connected to the inflator unit 18. Also in this case, all the direct or indirect connections with the inflator unit 18 are made in a gas-tight manner.

The first end 28 and the second end 30 of the connecting hose 22 can be provided with releasable connecting means so as to allow the detachment of the connecting hose 22 from the first inflatable chamber 14 and from the inflator unit 18.

Figure 15:
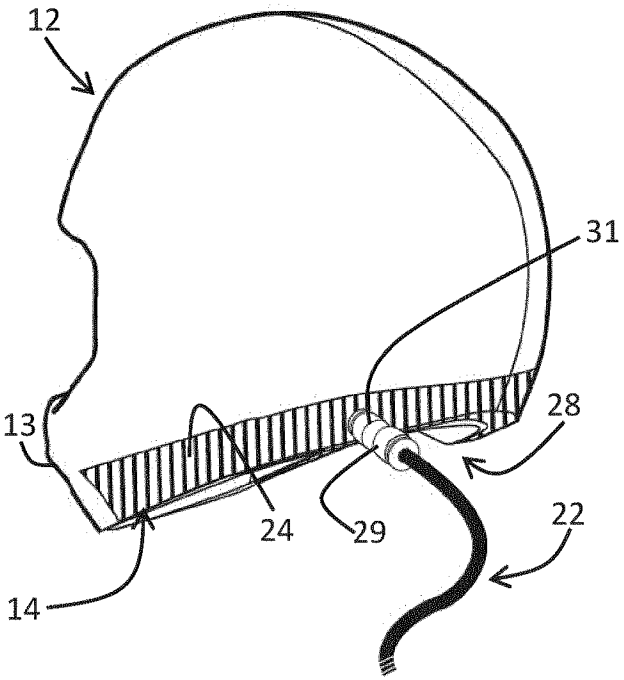
FIG. 15 shows an enlarged rear view of a further embodiment of the protective helmet of the wearable protection device according to the invention.

Preferably, as it is shown in FIG. 15, said releasable connecting means can consist in a plug-in connector 29 designed to be inserted in a corresponding connector 31 provided in the first inflatable chamber 14 or in the inflator unit 18.

As anticipated, the activation system 20 of the first inflatable chamber 14 is applied at the wearable element 16.

The activation system 20 can be an electronic or mechanical activation mechanism.

The electronic activation mechanism 20 preferably comprises at least one sensor 21 designed to detect forces acting on the wearable element 16, like for example an accelerometer, and/or to measure the angular velocity of the wearable element 16, like for example a gyroscope, and/or to detect the distance between the wearable element 16 and a target object, like for example ultrasonic distance sensor.

In the embodiments of the enclosed figures, two sensors 21 are applied at the shoulder portion of the wearable element 16 (see FIG. 13). Alternatively, or in addition, one or more sensors 21 can be applied inside the back protector 42 or inside the casing 40.

In a further embodiment, not shown in the figures, at least one sensor can also be applied on a vehicle, for example a motorcycle or a moto scooter, used in combination with the wearable protection device 10.

Different arrangements of the at least one sensor 21 are possible in order to meet other specific needs.

The electronic activation mechanism 20 can also comprise a control unit 23 designed to process the data detected by the sensor 21 and to send a triggering signal to the inflator unit 18, when a danger situation is identified.

The control unit 23 can be connected to the sensors 21 by means of a wired connection 25 (see for example FIG. 14) or a wireless connection (see for example FIGS. 3 and 13).

At the same time the control unit 23 is preferably electronically connected to the inflator unit 18. Advantageously, the control unit 23 can be housed inside the back protector 42 applied on the wearable element 16.

As it is shown, in FIGS. 3 and 14, the control unit 23 can be housed in the same casing 40 of the inflator unit 18, so as to be easily accessible if needed.

The control unit 23 is designed to process at regular time intervals the data received from the sensors 21 so as to obtain an information about the forces acting on the wearable element 16 and to calculate its spatial position and/or orientation.

If the control unit 23 detects, on the basis of an algorithm implemented therein, that a danger situation is occurring, a triggering signal is sent from the control unit 23 to the inflator unit 18 so that the first inflatable chamber 14 of the wearable protection device 10 can be inflated.

The mechanical activation system, in turn, can comprise an activation cable connecting the wearable element 16 to the vehicle used in combination with the wearable protection device 10.

The activation cable has a first end connected to the vehicle, for example a motorcycle, and a second end fixed to a triggering device which is designed to trigger a firing pin suitable for activating the inflator unit.

If a separation of the user of the wearable protection device 10 from the motorcycle occurs, the activation cable by means of the triggering device triggers the firing pin causing the inflator unit deployment.

The wearable element 16 also comprises at least one second inflatable chamber or bag 26.

Figure 12:
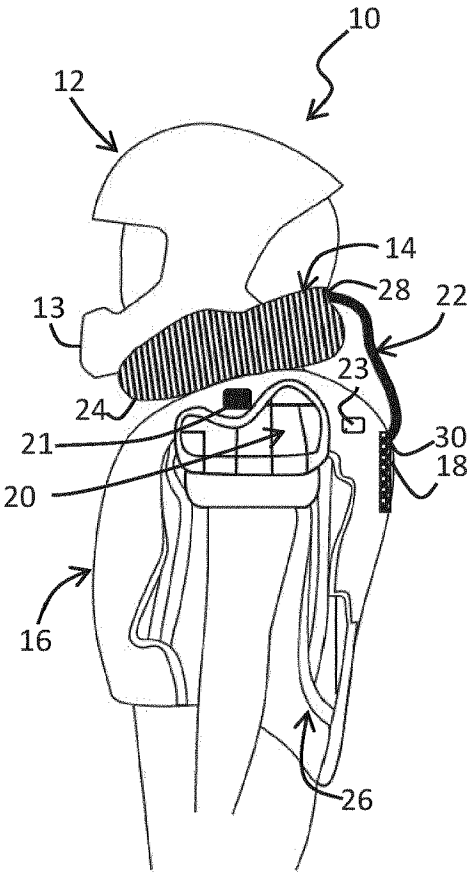
FIG. 12 is a figure similar to FIG. 11 wherein the inflatable chambers of the wearable protection device are in the inflated status.

Said second inflatable chamber 26 is suitable for moving between a rest condition, wherein it is in a deflated status (see for example FIG. 11), and an operating condition, wherein it is in an inflated status (see for example FIG. 12).

Preferably, the second inflatable chamber 26 is suitable for protecting the shoulders and/or the chest and/or the sides and/or the back of the user. Obviously, different arrangements of the second inflatable chamber 26 are possible, in order to meet other specific needs. For example, the inflatable chamber 26 can be designed to also protect the arms, the hips and/or the legs of the user.

The second inflatable chamber 26 can consist in a single inflatable bag or it can comprise in turn a plurality of distinct inflatable bags.

Said second inflatable chamber 26, similarly to the first inflatable chamber 14 can be a "sewed" airbag, an OPW airbag, a knitted airbag or an airbag made with elastic material.

The second inflatable chamber 26 can be of different type with respect of the first inflatable chamber 14.

For example, the second inflatable chamber 26 can be a chamber or bag made with an elastic material having a high elongation rate, so as to occupy a reduced volume in the deflated status, while the first inflatable chamber 14 can be a sewed or an OPW airbag or vice versa.

Moreover, also the second inflatable chamber 26 can be provided with internal tethers suitable for limiting its expansion.

Preferably, the second inflatable chamber 26 is housed in a seat provided in the wearable element 16, like for example a pocket or an interspace formed by two opposite surfaces of the wearable element 16. Alternatively, the second inflatable chamber 26 can be fixed to an inner or outer surface of the wearable element 16.

As it is shown in the attached figures, the inflator unit 18 can be connected to the second inflatable chamber 26. In detail, the inflator unit 18 can be designed to inflate said first chamber 14 and/or said second chamber 26 so as to move the first inflatable chamber 14 and/or the second inflatable chamber 26 in the operating condition.

As shown in the enclosed figures, preferably the inflator unit 18 is directly connected to said second chamber 26.

In a first embodiment, see for example FIG. 14, the connection of the second inflatable chamber 26 is carried out by directly clamping an end of the inflator unit inside an opening of the inflatable chamber 26. Alternatively, the end of the inflator unit 18 can be provided with an external thread suitable for being screwed inside a corresponding thread of a cap arranged at the opening of the second inflatable chamber 26.

Alternatively, the end of the inflator unit 18 can be connected to the second inflatable chamber 26 by means of a bayonet mount, wherein the male element is provided at the end of the inflator unit and a female receptor is provided at a cap arranged at the opening of the second inflatable chamber 26.

In the embodiment of FIG. 14, the inflator unit 18 comprises two gas cartridges, each gas cartridge being connected to a corresponding end of the second inflatable chamber 26. At least one of the two gas cartridge is also connected to the connecting hose 22.

In a further embodiment (see for example FIG. 13), the inflator unit 18 comprises two gas cartridges 32, 34. A first cartridge 32 is connected to the first inflatable chamber 14 by means of the connecting hose 22 and a second cartridge 34 is connected in a gas-tight manner to the second inflatable chamber 26.

In a different embodiment, not shown in the enclosed figures, the connecting hose can be Y-shaped. The bottom end of the Y-shape is connected to the inflator unit 18, while each upper end of the Y-shape is respectively connected to the first inflatable chamber 14 and to the second inflatable chamber 26.

In case of an indirect connection between the first inflatable chamber 14 and the inflator unit 18, the connecting hose 22 can have the first end 28 designed to be connected to the first inflatable chamber 14 and the second end designed to be connected, preferably in a gas-tight manner, to the second inflatable chamber 26 which acts as the intermediate element. In this embodiment, once the inflator unit 18 is triggered, the inflation gas firstly flows inside the second inflatable chamber 26 and from therein inside the first inflatable chamber 14.

Preferably, first and second inflatable chambers 14, 26 move at the same time in the operating condition (see for example FIGS. 2 and 12).

In other words, the second inflatable chamber 26 is advantageously designed to be inflated concurrently with the first inflatable chamber 14 when a danger situation is identified by the activation system 20.

Advantageously, first inflatable chamber 14 and second inflatable chamber 26 do not need to be provided with their own inflation unit and activation mechanism. As a matter of fact, first and second inflatable chambers 14, 26 are activated by means of a single inflation unit 18 and a single activation system 20.

Once the inflator unit 18 is triggered, the inflation gas flows instantaneously inside the first and second inflatable chambers 14, 26.

The inflator unit 18 is sized to provide enough inflation fluid for the inflation of both inflatable chambers.

In the embodiment wherein both first and second inflatable chambers are directly connected to the inflator unit 18, the inflation of a single inflatable chamber can be carried out. As a matter of fact, by removing the connection of the first or the second inflatable chambers with the inflator unit 18, the selective inflation of the first or the second inflatable chambers can be performed.

As it is clearly shown in FIG. 12, once activated, first and second inflatable chambers 14, 26 are designed to fill the gap between the lower rim of the protective helmet 12 and the upper portion of the wearable element 16 so as to protect the neck of the user.

In particular, the second inflatable chamber 26 is sized so as to cooperate with the first inflatable chamber 14 of the protective helmet 12 to fill the gap between the lower rim of the protective helmet and the shoulders of the user. Specifically, the second inflatable chamber 26 will be sized taking into account that, in the inflated status, the gap between the shoulder and the lower rim of the helmet is also partially occupied by the first inflatable chamber 14.

In particular, first and second inflatable chambers 14, 26 will be properly sized in order to permit that, following the activation, the first inflatable chamber 14 comes into contact with the second inflatable chamber 26 when it has substantially reached its maximum expansion, so as to avoid that the neck of user might undergo a traction force.

In order to maximize the protection offered by the wearable protection device both first and second inflatable chambers can be developed in different sizes so as to better match the user's measures.

At this point it is clear how the predefined objects may be achieved with the wearable protection device 10 according to the invention.

The wearable protection device 10 offers to the user an improved protection: the first inflatable chamber 14 is suitable for protecting the neck and the head of the user without hindering his movements during the normal use, as a matter of fact, the connecting hose 22 does not limit the freedom of movement of the user.

At the same time, the second inflatable chamber 26 is suitable for protecting the body of the user from impacts and contusions and to cooperate with the first inflatable chamber 14 so as to offer an improved protection to the neck and to the torso of the user.

Moreover, since the first inflatable chamber 14 is activated by using the inflator unit and the activation system applied at the wearable element 16, the provision of the first inflatable chamber 14 at the lower rim of the protective helmet has no impact, or very limited impact, on shape and volume of the protective helmet. In this way, the wearability and the comfort of the helmet is not affected.

Moreover, the wearable protection device is easy to use and wear. As a matter of fact, both the wearable element 16 and the protective helmet 12 can be worn as a normal garment and helmet, respectively. The user only needs to connect the connecting hose 22 to the first inflatable chamber 14.

Furthermore, the fact that first and second inflatable chambers are activated by a single activation system offers benefits in terms of safety, reliability and costs, related to purchasing and maintenance. For example, in case of activation, the user will be forced to change only a single inflator unit.

Again, the provision of the first inflatable chamber 14 on the protective helmet 12 permits to wear the wearable element 16 under jacket or suit without affecting the protection offered to the neck. The second inflatable chamber 26 of the wearable element 16 does not need to expand outwardly in order to protect the neck. This protection is already assured by the first inflatable chamber 14.

Finally, the provision of the inflator unit and the activation system on the wearable element 16 permits not to modify the shape of the protective helmet so as not to affect the sliding of the outer shell over the ground in case of an accident.

With regard to the embodiments of the wearable protection device 10 described above, the person skilled in the art may, in order to satisfy specific requirements, make modifications to and/or replace elements described with equivalent elements, without thereby departing from the scope of the accompanying claims.

The invention claimed is:

1. A wearable protection device comprising:

a protective helmet provided with at least one first inflatable chamber suitable for moving between a rest condition in a deflated status and an operating condition, in an inflated status;

a wearable element comprising an inflator unit and an activation system;

the activation system being configured to trigger the inflator unit if a danger situation for the user of the wearable protection device is identified;

characterized in that the wearable element comprises at least one second inflatable chamber suitable for moving between a rest condition in a deflated status, and an operating condition in an inflated status;

the inflator unit being connectable to one or more of said at least one first inflatable chamber and said at least one second inflatable chamber and being configured to selectively inflate said at least one first inflatable chamber or said at least one second inflatable chamber or both so as to move said at least one first inflatable chamber or said at least one second inflatable chamber or both in the operating condition when a danger situation for the user of the wearable protection device is identified by the activation system;

wherein the wearable element is configured to cover at least a trunk portion of the body of the user.

2. The wearable protection device according to claim 1, characterized in that the inflator unit is directly or indirectly connected to said at least one first inflatable chamber by means of a connecting hose.

3. The wearable protection device according to claim 2, characterized in that the connecting hose is made with a flexible material.

4. The wearable protection device according to claim 2, characterized in that the connecting hose is configured to be positioned at least partially inside the wearable element.

5. The wearable protection device according to claim 2, characterized in that the connecting hose has a first end configured to be connected to said at least one first inflatable chamber and a second end configured to be connected to the inflator unit;

said first end and said second end being provided with releasable connecting means allowing the detachment of the connecting hose from said at least one first inflatable chamber and from said inflator unit.

6. The wearable protection device according to claim 2, characterized in that the inflator unit is indirectly connected to said at least one first inflatable chamber by means of a connecting hose;

said connecting hose having a first end configured to be connected to said at least one first inflatable chamber and a second end configured to be connected to said at least one second inflatable chamber.

7. The wearable protection device according to claim 1, wherein said at least one first inflatable chamber is applied at a lower portion of the protective helmet.

8. The wearable protection device according to claim 1, characterized in that the inflator unit is applied at the portion of the wearable element configured to cover the back of the user.

9. The wearable protection device according to claim 8, characterized in that said at least one first inflatable chamber is partially or fully installed inside a lower portion of the protective helmet.

10. The wearable protection device according to claim 9, characterized in that said at least one first inflatable chamber is provided inside a housing applied or arranged at the lower portion of the protective helmet.

11. The wearable protection device according to claim 10, characterized in that said at least one first inflatable chamber or the housing are fixed to the lower rim of the protective helmet by means of releasable fixing means.

12. The wearable protection device according to claim 1, characterized in that said at least one second inflatable chamber is configured to be inflated concurrently with said at least one first inflatable chamber when a danger situation is identified by the activation system.

13. The wearable protection device according to claim 1, characterized in that said at least one first inflatable chamber and said at least one second inflatable chamber in their operating condition are configured to fill a gap between a lower rim of the protective helmet and an upper portion of the wearable element so as to protect the neck of the user.

14. The wearable protection device according to claim 1, characterized in that said inflator unit comprises two gas cartridges;

a first cartridge being connected by means of a connecting hose to said at least one first inflatable chamber and a second cartridge being connected in a gas-tight manner to said at least one second inflatable chamber.

15. The wearable protection device according to claim 1, characterized in that said at least one second inflatable chamber is configured to protect one of more of shoulders, chest, sides, and back of the user.

16. The wearable protection device according to claim 1, characterized in that the inflator unit is removably connected to one or more of said at least one first inflatable chamber and said at least one second inflatable chamber;

said at least one first inflatable chamber and said at least one second inflatable chamber being selectively inflatable by removing the connection between said one or more of at least one first inflatable chamber or at least one second inflatable chamber with the inflator unit.

17. The wearable protection device according to claim 1, characterized in that the activation system comprises a control unit configured to process data detected by at least one sensor applied at the wearable element.

18. The wearable protection device according to claim 17, characterized in that said at least one sensor is configured to one or more of detecting forces acting on the wearable element, measuring the angular velocity of the wearable element, and detecting the distance between the wearable element and a target object.

* * * * *